US012569038B2

(12) United States Patent
Khalsa

(10) Patent No.: US 12,569,038 B2
(45) Date of Patent: Mar. 10, 2026

(54) GARMENTS WITH SEMI-PRECIOUS STONE SNAPS

(71) Applicant: God's True Cashmere LLC, Los Angeles, CA (US)

(72) Inventor: Sat Hari Kaur Khalsa, Los Angeles, CA (US)

( * ) Notice: Subject to any disclaimer, the term of this patent is extended or adjusted under 35 U.S.C. 154(b) by 0 days.

(21) Appl. No.: 18/439,702

(22) Filed: Feb. 12, 2024

(65) Prior Publication Data

US 2024/0389717 A1 Nov. 28, 2024

Related U.S. Application Data

(60) Provisional application No. 63/468,482, filed on May 23, 2023.

(51) Int. Cl.
*A44B 1/04* (2006.01)

(52) U.S. Cl.
CPC ..... *A44B 1/04* (2013.01)

(58) Field of Classification Search
CPC ..... A44B 1/04; A44C 17/02; A44C 17/04; A44C 17/005; A44C 27/00; Y10T 24/3694; B23P 5/00
USPC ..... 29/10; 63/26
See application file for complete search history.

(56) References Cited

U.S. PATENT DOCUMENTS 603,202 A * 4/1898 Pfenning ..... A44B 17/0088 24/680
1,004,505 A * 9/1911 Verneuil ..... C30B 29/26 501/86
1,368,878 A * 2/1921 Bandell ..... A44B 17/0082 24/453
3,091,540 A * 5/1963 Nielsen ..... C30B 29/26 501/86
3,539,379 A * 11/1970 Mayer ..... C04B 41/5031 427/255.19
3,864,939 A * 2/1975 Phillips ..... C03B 37/15 501/86
4,030,317 A * 6/1977 Rogell ..... A44C 17/00 501/86
4,672,718 A * 6/1987 Schlueter ..... A44B 1/04 24/114.9
5,014,400 A * 5/1991 Ban ..... A44B 17/0088 24/114.9
5,195,220 A * 3/1993 Herman ..... A44B 11/001 24/163 K
5,255,417 A * 10/1993 Herman ..... A44B 11/001 24/113 MP (Continued)

OTHER PUBLICATIONS

Valves Instruments Plus Ltd; Thermal Expansion; https://www.vip-ltd.co.uk/Expansion/Thermal_Expansion.pdf; 1 page (Year: 2019).*

*Primary Examiner* — Jason W San
*Assistant Examiner* — Louis A Mercado
(74) *Attorney, Agent, or Firm* — Fulwider Patton LLP

(57) ABSTRACT

A snap and a method for making a snap using on articles of clothing where an ornamental crystal or gem stone occupies a visible portion of the snap. To construct the snap, a housing is provided that is adapted to receive a shaped ornamental substrate only after thermally expanding the substrate, and the snap can then be used on articles of clothing to enhance the appearance of the clothing.

5 Claims, 3 Drawing Sheets

(56) References Cited

U.S. PATENT DOCUMENTS 5,361,606 A * 11/1994 Nhaissi ..... A44C 17/02 63/26
5,423,196 A * 6/1995 Pollack ..... A44C 17/04 63/28
5,526,551 A * 6/1996 Herman ..... A44C 17/02 24/712.1
5,542,157 A * 8/1996 Herman ..... A44B 1/04 24/113 MP
5,723,391 A * 3/1998 Hunter ..... C30B 29/36 501/86
5,882,786 A * 3/1999 Nassau ..... C30B 29/04 428/408
6,012,203 A * 1/2000 Baron Pearson ..... A43B 23/24 24/114.9
6,048,813 A * 4/2000 Hunter ..... C30B 29/36 501/86
7,856,697 B2 * 12/2010 Quimod ..... A44B 1/14 24/114.9
8,590,185 B1 * 11/2013 Jardine ..... G09F 21/02 40/586
10,206,464 B2 * 2/2019 Lauper ..... G04B 45/00
10,602,814 B1 * 3/2020 Dholakiya ..... A44C 25/001
11,116,264 B2 * 9/2021 Adams ..... A44B 1/04
2006/0032270 A1 * 2/2006 Doyno ..... A44C 17/0233 63/29.1
2009/0056374 A1 * 3/2009 Abate ..... A44C 17/001 63/26
2009/0308102 A1 * 12/2009 Miller ..... C22C 1/051 63/15
2012/0240622 A1 * 9/2012 Sorenson ..... A44C 17/006 63/32
2013/0174314 A1 * 7/2013 Candemir ..... A41D 27/08 2/69
2014/0075990 A1 * 3/2014 Botha ..... A44C 17/02 63/26

* cited by examiner

FIG. 2
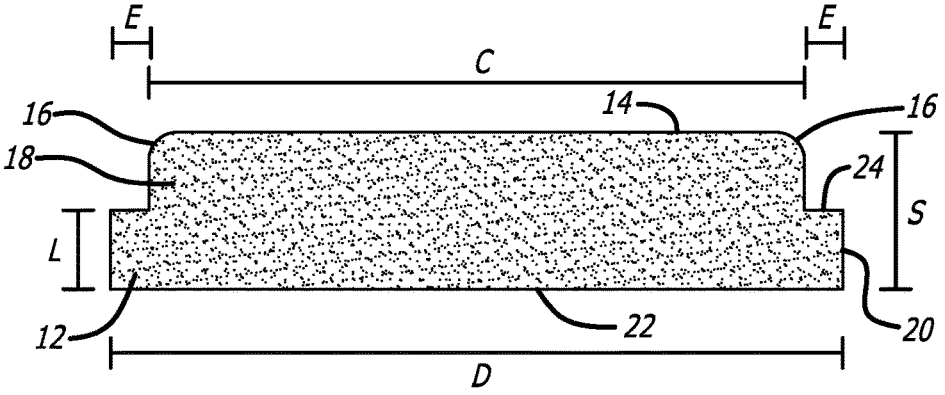
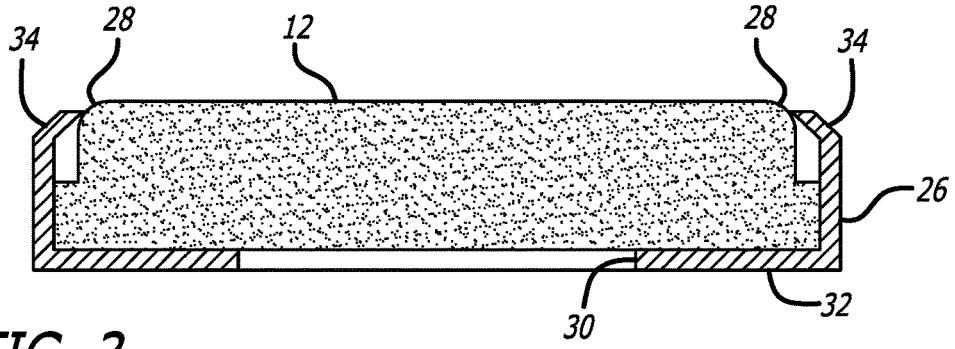
FIG. 3
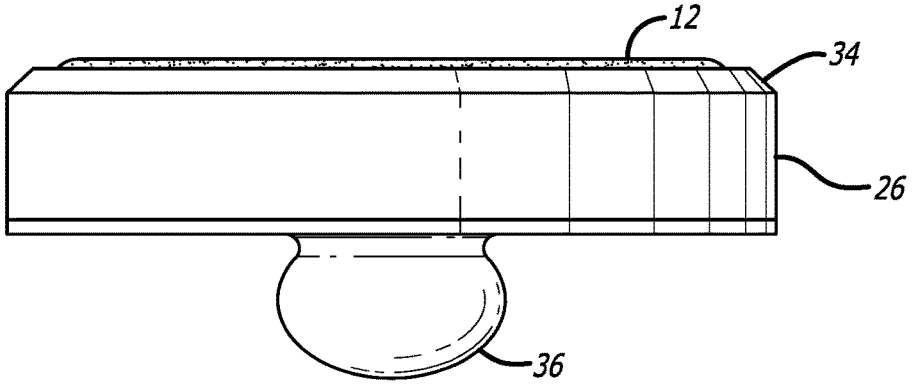
FIG. 4

GARMENTS WITH SEMI-PRECIOUS STONE SNAPS

CROSS-REFERENCES TO RELATED APPLICATIONS

This application claims priority to U.S. Provisional Patent Application No. 63/468,482 filed May 23, 2023, the content of which is incorporated herein by reference in its entirety.

BACKGROUND

This application relates generally to innovations in clothing ornamentation, and more particularly to a method for producing gemstones that serve as shirt snaps and shirts having such embellishments.

Garment snaps, also known as press studs or poppers, have a rich history dating back to the mid-19th century. The concept of a fastener that could be easily and securely closed and opened was a significant development in the world of garment manufacturing. In 1885, German inventor Heribert Bauer patented the first commercially viable snap fastener, revolutionizing the way clothes were made and worn. This invention marked a significant departure from traditional button and loop closures, and quickly gained popularity for its convenience and practicality.

While garment snaps were initially designed for their utilitarian function, they also became popular for their ornamental role in fashion. As the use of snaps became more widespread, designers and manufacturers began to incorporate them as decorative elements in addition to their practical purpose. This shift led to the development of snaps in various shapes, sizes, and materials, allowing them to be used as embellishments to enhance the aesthetic appeal of garments. The ornamental function of garment snaps became particularly prominent in the world of denim and workwear, where brass or copper snaps were used to add a rugged and industrial touch to clothing.

During the mid-20th century, garment snaps experienced a surge in popularity as they became closely associated with Western wear and cowboy fashion. Snaps were prominently featured on cowboy shirts, denim jackets, and other Western-style garments, often adorned with decorative designs such as stars, arrows, and horseshoes. The use of snaps in Western fashion not only contributed to their ornamental function but also cemented their status as a symbol of rugged individualism and frontier spirit.

In the modern era, garment snaps continue to serve both practical and ornamental purposes in fashion. They are commonly used in a wide range of garments, including shirts, jackets, jeans, and accessories. Designers often incorporate snaps creatively, using them to add visual interest, create unique patterns, or make a statement. With advancements in manufacturing techniques and materials, garment snaps have evolved to offer a wide array of decorative options, including custom finishes, embossed designs, and colorful enamel coatings, further enhancing their ornamental appeal in contemporary fashion. However, this expansion has not reached the incorporation of gem stones and crystals as part of the decorative aspect of snaps. This application addresses this need.

SUMMARY OF THE INVENTION

The present invention is a novel approach to creating a flourish in clothing focusing on the snap. In light of the popular belief in the healing properties of crystals, the present inventor sought to craft a snap from crystals and then place such snaps on a line of clothing. However, crystals do not lend themselves to such manipulation easily and a series of experiments were undertaken in an attempt to form a crystal into the needed shape and size. Starting with stones in the ten to twenty millimeter range, the process requires painstaking patience to cut the stones into hemispheres without breaking the stones. Stones and crystals having a Rockwell hardness value of between 7 and 10 were found to work best and yield the best results.

Once the stones are cut into hemispheres, the resulting stones are set into a button casing sized to receive the stone. Heat is used to fit the stone into the casing, such that when it cools the casing is permanently cast on the stone. A protective enamel finish, typically transparent, is then applied to the button to protect the stone and give it a shiny finish.

BRIEF DESCRIPTION OF THE DRAWINGS

FIG. 2 is a cross sectional view of a crystal cut into a cylindrical shape;

FIG. 3 is a cross sectional view of the crystal of FIG. 2 inside a metallic casing;

FIG. 4 is a side view of the crystal/casing combination;

DETAILED DESCRIPTION OF THE PREFERRED EMBODIMENTS

Figure 1:
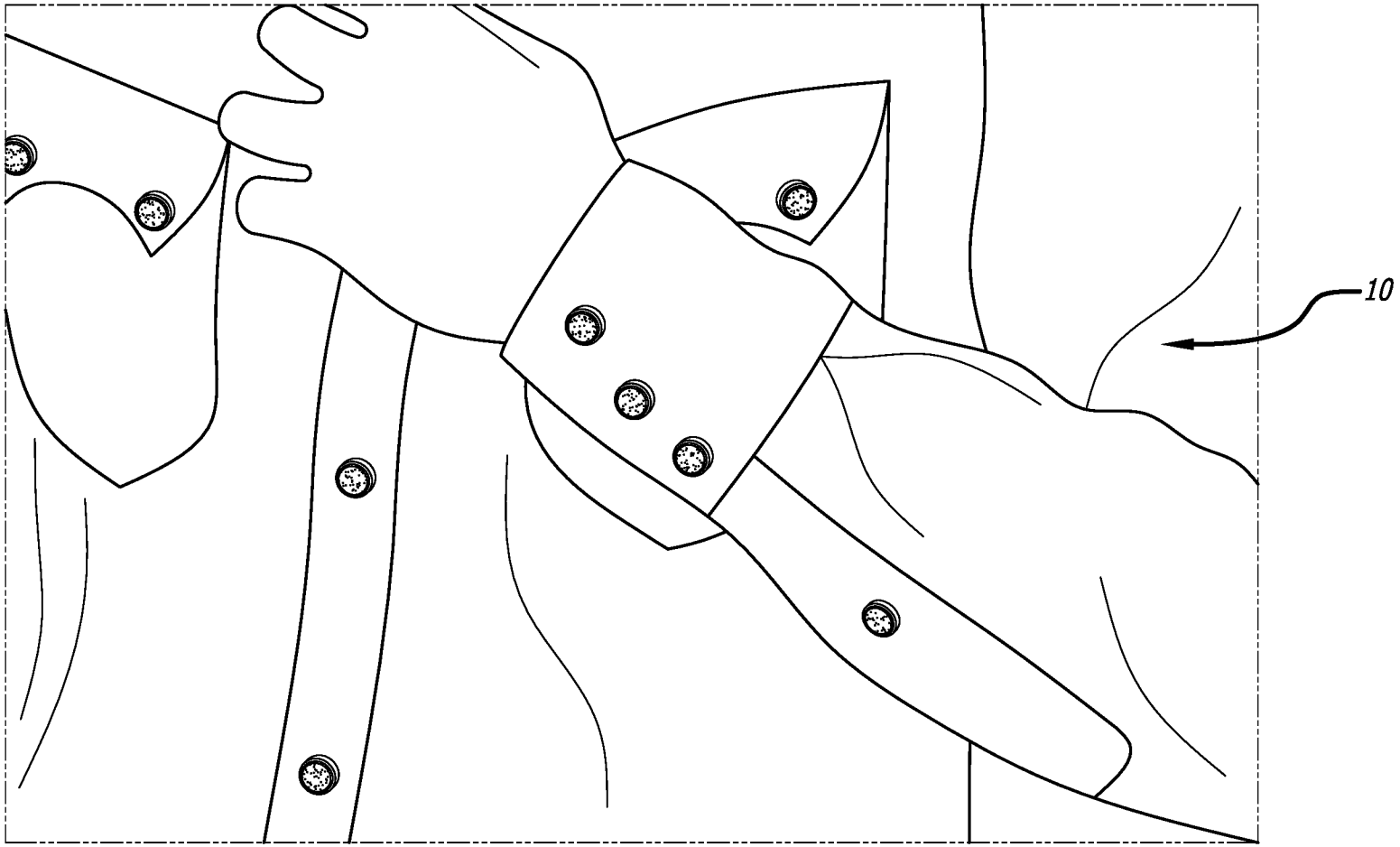
FIG. 1 is an illustration of a garment using the present invention.

FIG. 1 is a garment 10 of the type that may be used with the present invention. While FIG. 1 shows a particular type of garment (i.e., a shirt or blouse), it is understood that the invention is not limited to any particular type of garment and that the invention may be used with any article of clothing.

FIG. 2 illustrates a profile of a gem stone or crystal 12 that has been shaped into a particular geometric volume for purposes of the invention. The process by which the substrate stone or crystal 12 is shaped involves rough and then fine abrasions until the desired shape is obtained. Specifically, the stone/crystal is shaped so as to have a flat upper surface 14 with rounded corners 16 at the periphery to form a dome-type structure 18 on the upper half of the stone 12. The lower half 20 of the stone is formed to have a larger diameter cylindrical base with a flat lowermost surface 22. The different diameter cylinders 18,20 define a shoulder 24 at the transition, where the shoulder 24 is located at approximately one half of the full height of the stone. Exemplary dimensions of the stone/crystal 12 of FIG. 2 have a diameter D of 9.5 mm and a height S of 2 mm. The offset E is 0.5 mm leaving the smaller diameter C at 8.5 mm. The thickness of the ledge L is 1 mm. These dimensions are illustrative only and are not limitations of the design itself.

Figure 5:
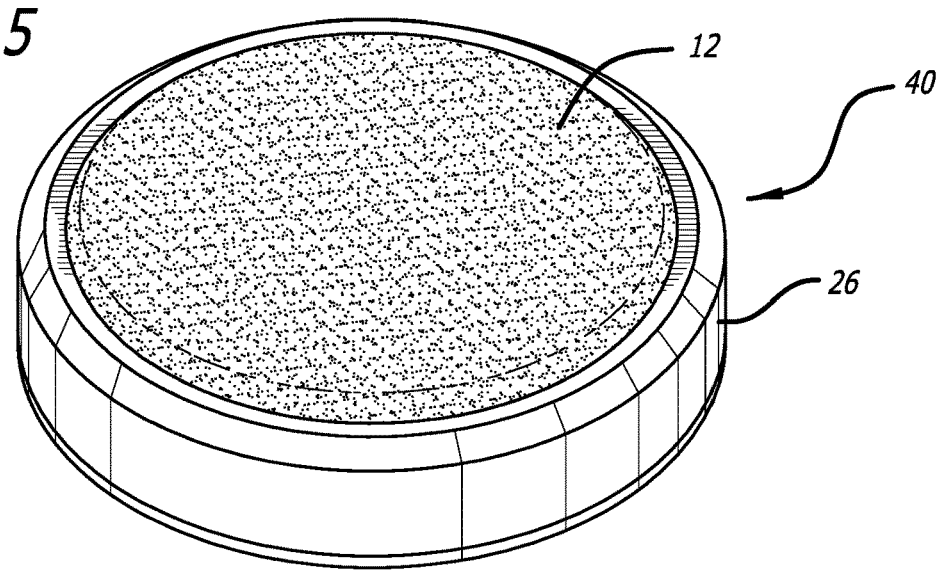
FIG. 5 is an elevated, perspective view of the crystal/casing combination of FIG. 4.

FIG. 3 shows the stone/crystal encased in a cylindrical housing 26 with a circular opening 28 along the top surface and a smaller circular opening 30 at the bottom surface 32. The upper opening is formed by a radially inwardly angled projection 34 that creates a bevel for purchase of the rounded corner 16 of the stone 12. The inwardly formed projection locks the stone 12 in the housing 26 while displaying a maximum surface area of the top (i.e., dome structure 18) of the stone. The bottom opening 30 serves to show the stone from the bottom. A snap peg 36 can be connected to the housing 26 (see FIG. 4) to form the upper half of the snap, or the housing can be left alone and serve as a button. FIG. 5 shows the completed snap 40 with the stone and housing together.

Figure 6:
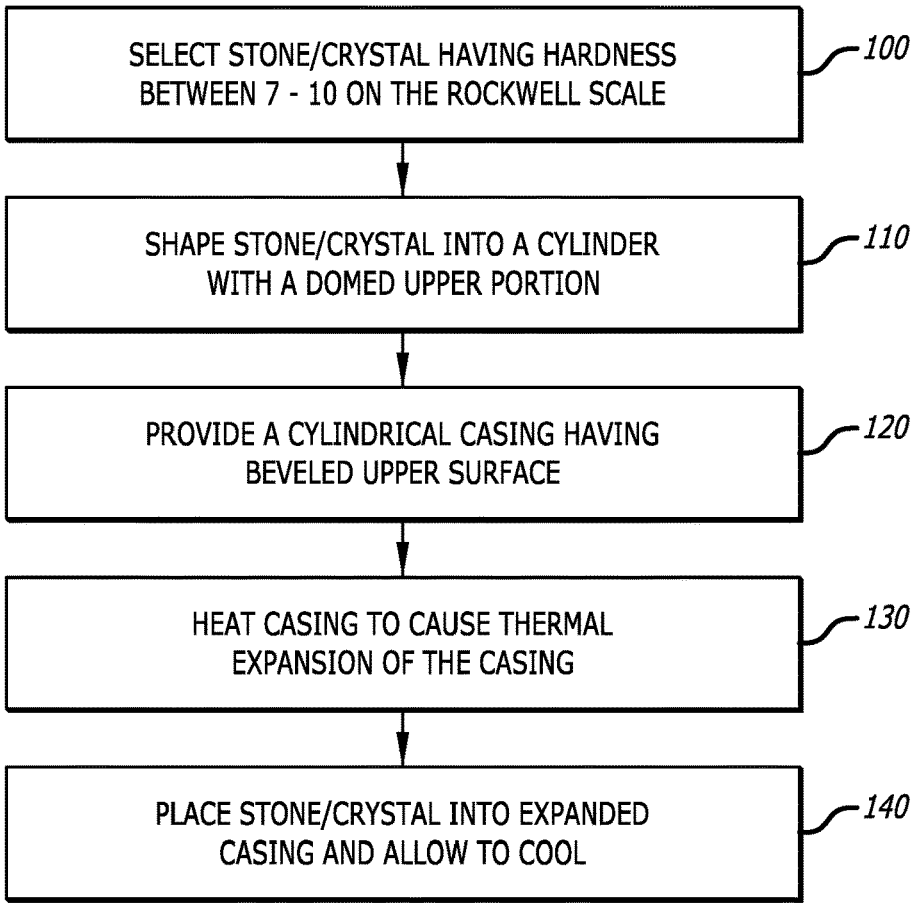
FIG. 6 is flow chart for a method of constructing the crystal/casing combination.

FIG. 6 illustrates a method for forming the snap 40 according to the invention. Step 100 requires that a crystal or gem stone having a Rockwell hardness of between 7.0 and 10.0 be selected for incorporation into the snap. In step 110, the stone or crystal is cut and buffed into the two-tier shape of FIG. 2, and in step 120 the cylindrical housing or casing is secured to a vice, tool, or suitable surface. The casing is then heated to expand the casing by at least 3-5% to enable the shaped stone/crystal to be inserted into the expanded opening. The casing is then permitted to cool in step 140, trapping the gem stone inside the casing and forming the snap. Preferably a snap peg is then attached to the casing via welding, adhesive, or other suitable attachment, and the snap is paired with a mating snap receiving portion and both components are attached to an article of clothing such as shown in FIG. 1.

While the foregoing depicts one preferred embodiment of the invention, it is understood that there are many other modifications and substitutions that can be made without departing from the scope and spirit of the invention, and the invention should not be interpreted as being limited in any way to the shapes, sizes, colors, or dimensions set forth above. Rather, the invention's scope will be determined by the appended claims along with the description of the invention, including the drawings, without undue limitations.

I claim:

1. A method for forming a snap for use with an article of clothing, comprising:

selecting a gem stone;

shaping the gem stone into a two tier structure, a lower tier having a first height and further comprising a flat lowermost surface and a cylindrical base of a first diameter, and an upper tier having a second height approximately equal to the first height and further comprising a cylindrical portion of a second diameter less that said first diameter, a flat upper surface, said flat upper surface including a rounded circumferential corner, a transition of the lower tier to the upper tier forming a shoulder at a midline of the gem stone;

providing a cylindrical housing having an inner diameter sized to receive the lower tier of the gem stone therein, said cylindrical housing having a flat floor abutting the flat lowermost surface of the lower tier, said cylindrical housing further comprising a circular opening smaller than said first diameter and positioned to provide viewing of the gem stone from below the cylindrical housing, a circumferential wall of the cylindrical housing includes an upper edge extending to a wall height above the first height of the lower tier and below said flat upper surface of the upper tier;

forming the cylindrical housing with an angled, inwardly and upwardly projecting member extending from the upper edge of the cylindrical housing;

heating the cylindrical housing to expand the cylindrical housing such that a circular opening formed by a distal tip of the projecting member expands to an opening diameter greater than said first diameter of the lower tier;

inserting the gem stone into the heated cylindrical housing; and cooling the cylindrical housing until the angled, inwardly and upwardly projecting member bears against the rounded circumferential corner, trapping the gem stone inside the cylindrical housing.

2. The method of claim 1, wherein a ratio of the first diameter to the second diameter is 9.5:8.5.

3. The method of claim 1, wherein further comprising attaching a snap peg to the flat floor of the cylindrical housing.

4. The method of claim 3, wherein the snap peg is welded to the flat floor of the cylindrical housing.

5. The method of claim 1, wherein the gem stone has a Rockwell hardness value of between 7 and 10.

* * * * *